US006380666B1

(12) United States Patent
Kawato

(10) Patent No.: US 6,380,666 B1
(45) Date of Patent: Apr. 30, 2002

(54) TIME-OF-FLIGHT MASS SPECTROMETER

(75) Inventor: Eizo Kawato, Cheadle (GB)

(73) Assignee: Shimadzu Research Laboratory (Europe) Ltd., Manchester (GB)

( * ) Notice: Subject to any disclaimer, the term of this patent is extended or adjusted under 35 U.S.C. 154(b) by 0 days.

(21) Appl. No.: 09/530,091

(22) PCT Filed: Jan. 12, 1999

(86) PCT No.: PCT/GB99/00084

§ 371 Date: Sep. 7, 2000

§ 102(e) Date: Sep. 7, 2000

(87) PCT Pub. No.: WO99/39368

PCT Pub. Date: Aug. 5, 1999

(30) Foreign Application Priority Data

Jan. 30, 1998 (GB) ..... 9802111

(51) Int. Cl.[7] ..... H01J 49/42; H01J 49/40

(52) U.S. Cl. ..... 313/359.1; 313/363.1; 250/287; 250/282; 250/281; 250/292

(58) Field of Search ..... 313/359.1, 363.1; 250/287, 282, 281, 292

(56) References Cited

U.S. PATENT DOCUMENTS 5,569,917 A * 10/1996 Buttrill, Jr. et al. ..... 250/292

OTHER PUBLICATIONS

Alheit et al., "Higher order non–linear resonances in a Paul trap," *Int'l J of Mass Spectr. and Ion Processes*, 154, pp. 155–169 (1996).

* cited by examiner

*Primary Examiner*—Jack Berman
*Assistant Examiner*—Nikita Wells
(74) *Attorney, Agent, or Firm*—Leydig, Voit & Mayer, Ltd.

(57) ABSTRACT

A time-of-flight spectrometer comprises a quadrupole ion trap (10) as an ion source, a drift tube (11) defining a field-free drift space, an ion reflector (12) and an ion detector (13). The quadrupole ion trap (10) has two end-cap electrodes (22, 23) and a ring electrode (21). End-cap electrode (22) has a central hole (24) through which ions to be extracted can pass. High voltage power supplies (34, 35) and associated switching devices (32, 33) are provided to supply extraction voltages to the end-cap electrodes (22, 23). The extraction voltage supplied to end-cap electrode (22) has the opposite polarity to the extraction voltage supplied to the other end-cap electrode (23) being respectively negative and positive voltages for positive ion extraction and respectively positive and negative voltages for negative ion extraction. The magnitude of the extraction voltage supplied to electrode (23) is in the range from 0.5 to 0.8 that of the extraction voltage supplied to electrode (22).

17 Claims, 3 Drawing Sheets

TIME-OF-FLIGHT MASS SPECTROMETER

FIELD OF THE INVENTION

The present invention relates to a time-of-flight mass spectrometer. More specifically, the invention relates to a time-of-flight mass spectrometer comprising an ion source in the form of a quadrupole ion trap, an ion detector and a field-free drift space between the ion source and the ion detector. Usually, though not necessarily, there will also be provided an ion reflector between the ion source and the ion detector.

BACKGROUND OF THE INVENTION

A quadrupole ion trap comprises a pair of end-cap electrodes and a ring electrode. One of the end-cap electrodes has a central hole through which ions can be extracted for transmission along a field-free drift space. The invention is particularly concerned with the optimal extraction of ions from the quadrupole ion trap.

A quadrupole ion trap device is widely used in mass analysis of ions and/or molecular structure analysis of a chemical composite by trapping ions using a high voltage radio-frequency (RF), selecting specific ions in dependence on their mass-to-charge ratio, cooling ions by collisions with buffer gas, and many other associated techniques. This area of application of quadrupole ion trap devices has been discussed in various articles, for example, in "Practical Aspects of Ion Trap Mass Spectrometry volume 1 (1995, CRC Press)".

Recently attempts have been made to use a quadrupole ion trap as an ion source for a time-of-flight mass spectrometer due to the superior ability of the quadrupole ion trap to cool the ion energy to a level which is sufficiently low to be suitable for high resolution analysis of the time-of-flight. While a time-of-flight mass spectrometer compensates for a spread of flight times for a certain range of initial ion energies emitted from the ion source, a reduced spread of flight times using the smaller range of initial energies in the quadrupole ion trap gives higher resolution. The disclosure in U.S. Pat. No. 5,569,917 suggests that it is important to optimize the operational parameters of the quadrupole ion trap to obtain a high-resolution mass spectrum and a high sensitivity for trace analysis. This patent discloses a quadrupole ion trap (shown in FIG. 1) utilizing a bipolar extraction field whereby extraction voltages of the same magnitude (between 200V and 550V), or almost the same magnitude, but of opposite polarity are applied to the end-cap electrodes. In a particular example, voltages of +500V and −420V were used, the positive voltage having a slightly larger value so as to produce a parallel ion beam after the ions have be en emitted into the field-free drift space of the time-of-flight mass spectrometer. Post acceleration is also used where by ions initially accelerated to an energy of about 500 eV in the quadrupole ion trap continue to be accelerated by an electric field outside the quadrupole ion trap to obtain an energy required for time-of-flight mass analysis, usually in the range from 5 keV to 30 keV. Ion beam focusing is also affected by this post-acceleration and this effect is allowed for by adjustment of the magnitudes of the voltages applied to the two end-cap electrodes.

It is an object of the present invention to provide a time-of-flight mass spectrometer incorporating a quadrupole ion trap having an improved performance.

SUMMARY OF THE INVENTION

According to one aspect of the invention there is provided a time-of-flight mass spectrometer comprising a quadrupole ion trap as an ion source, an ion detector and a field-free drift space between the quadrupole ion trap and the ion detector, the quadrupole ion trap having a ring electrode and two end-cap electrodes, at least one of the end-cap electrodes having at least one hole at its centre through which ions can be extracted in use, and voltage supply means for supplying to said at least one end-cap electrode a first extraction voltage relative to the ring electrode and for supplying to another said end-cap electrode a second extraction voltage relative to the ring electrode having the opposite polarity to said first extraction voltage, said first and second extraction voltages being respectively negative and positive voltages for positive ion extraction and being respectively positive and negative voltages for negative ion extraction, the second extraction voltage having a magnitude in the range from 0.5 to 0.8 of that of said first extraction voltage.

According to another aspect of the invention there is provided a method for forming an ion beam using a quadrupole ion trap having a ring electrode and two end-cap electrodes, at least one of the end-cap electrodes having at least one hole at its centre through which ions can be extracted, in use, the method comprising supplying to said at least one end-cap electrode a first extraction voltage relative to the ring electrode and supplying to another said end-cap electrode a second extraction voltage relative to the ring electrode having the opposite polarity to said first extraction voltage, said first and second extraction voltages being respectively negative and positive voltages for positive ion extraction and being respectively positive and negative voltages for negative ion extraction, the second extraction voltage having a magnitude in the range from 0.5 to 0.8 of that of said first extraction voltage.

According to a yet further aspect of the invention there is provided a quadrupole ion trap having a ring electrode and two end-cap electrodes, at least one of the end cap electrodes having at least one hole at its centre through which ions can be extracted, in use, and voltage supply means for supplying to said at least one end-cap electrode a first extraction voltage relative to the ring electrode and for supplying to another said end-cap electrode a second extraction voltage relative to the ring electrode having the opposite polarity to said first extraction voltage, said first and second extraction voltages being respectively negative and positive voltages for positive ion extraction and being respectively positive and negative voltages for negative ion extraction, the second extraction voltage having a magnitude in the range from 0.5 to 0.8 of that of said first extraction voltage.

Recent investigations by the inventor into the operation of a time-of-flight mass spectrometer incorporating a quadrupole ion trap as the ion source and into the systematic design of an ion reflector in order to achieve high resolution gave unexpected results.

Initially, a relatively high extraction field was used inside the quadrupole ion trap with a view to obtaining the highest possible electric field for ion extraction whereby to reduce turn-around time. This was done because turn-around time tends to dominate time spread in the spectrometer which should be reduced to achieve higher resolution. The turn-around time is the time taken by an ion having a small initial velocity directed away from the extraction end-cap electrode to return to the initial position with the same velocity but in the opposite direction. A high extraction field was used inside the quadrupole ion trap to enable ions to acquire enough energy for time-of-flight analysis without the need for any post acceleration following their extraction.

Quite unexpectedly, and contrary to the teaching of U.S. Pat. No. 5,569,917, it was found as a result of these investigations that the optimum electric field configuration inside the quadrupole ion trap was established when the magnitude of the second extraction voltage (a positive voltage for positive ions) was only 0.6 that of the first extraction voltage (a negative voltage for positive ions) and it was also found that relative magnitudes having a ratio in the range from 0.5 to 0.8 also gave desirable results. It was found that when the magnitude of the second extraction voltage was 0.6 that of the first extraction voltage ions inside the ion trap experienced an acceleration voltage as high as 90% that of the first extraction voltage.

Slightly curved equi-potential lines concentric to the surface of the extraction end-cap electrode smoothly accelerate ions in to the hole in the end-cap electrode with slightly convergent trajectories. However, termination of the electric field at and around the hole causes a slight divergence which compensates for the convergent trajectories giving a parallel ion beam outside the quadrupole ion trap. The curvature of the equi-potential lines causes a slight shift in the energies of ions initially occupying a plane perpendicular to the extraction axis. However, an ion reflector has the capability to cancel out the effect of this energy shift from the total flight time measured at the surface of the ion detector.

In an example, a first extraction voltage of −10 kv was applied to the extraction end-cap electrode and a second extraction voltage of +6 kV was applied to the other end-cap electrode, where both extraction voltages are expressed relative to the voltage on the ring electrode. Ions originating from the centre of the quadrupole ion trap were found to have an energy of 9 keV after being emitted into a field-free drift space. In the field-free drift space the ions had almost parallel trajectories without the need for post-acceleration or an electrostatic lens to focus the beam, and so the ions were reflected in the ion reflector towards the ion detector without any significant loss of intensity thereby achieving high sensitivity. The inventor considered another possibility of accelerating the ions using a much higher extraction field followed by post-deceleration so as to reduce the ion energy in front of the field-free drift space. The beam divergence caused by post-deceleration can be compensated by further reducing the ratio of the extraction voltages. However, this seems less effective because of the requirement to apply much higher voltages to the end-cap electrodes than those in previous examples.

There is another type of voltage configuration in which the field-free drift space and the extraction end-cap electrode are maintained at ground voltage and the ring electrode and the other end-cap electrode have applied positive voltages, namely +10 kV and +16 kV, respectively. This configuration doesn't change the relative voltage differences between the electrodes, but only shifts all the voltages by 10 kV. This has the advantage that the field-free drift space can be at ground voltage thereby eliminating the need to apply a floating voltage to the flight tube. Otherwise the voltage +16 kv must be switched at ion extraction, which increases the practical difficulty of handling higher voltage.

It was found that an approximate time focussing occurs in the field-free drift space, about 37.4 mm from the centre of the quadrupole ion trap. However, this is not regarded as important or necessary. The ion reflector can be so designed as to take into account the time spent in the quadrupole ion trap so as to produce a much smaller time spread at the ion detector surface than at the aforementioned approximate time focussing plane.

In the investigations carried out by the inventor, the extraction end-cap electrode had a surface provided with a cone-shaped hump around the central hole. The end-cap electrodes were nominally positioned such that the asymptotes of the ring and end-cap electrodes were coincident at the centre of the quadrupole ion trap. Another well known form of the quadrupole ion trap has a stretched geometry in which both end-cap electrodes are each moved apart by 0.76 mm from their nominal positions. In this case the optimum electric field configuration was achieved by applying a first extraction voltage of −10 kv to the extraction end-cap electrode and a second extraction voltage of +7 kv to the other end-cap electrode, a ratio of 0.7. It was found that the optimum ratio of the second voltage to the first voltage increases as the geometry of the guadrupole ion trap becomes more stretched. The diameter of the hole in the end-cap electrodes also affects the optimum ratio of the voltages, but this has a lesser effect than does the extent of stretching.

BRIEF DESCRIPTION OF THE DRAWINGS

Embodiments of the invention are now described, by way of example only, with reference to the accompanying drawings of which.

DETAILED DESCRIPTION OF PREFERRED EMBODIMENT

Figure 1:
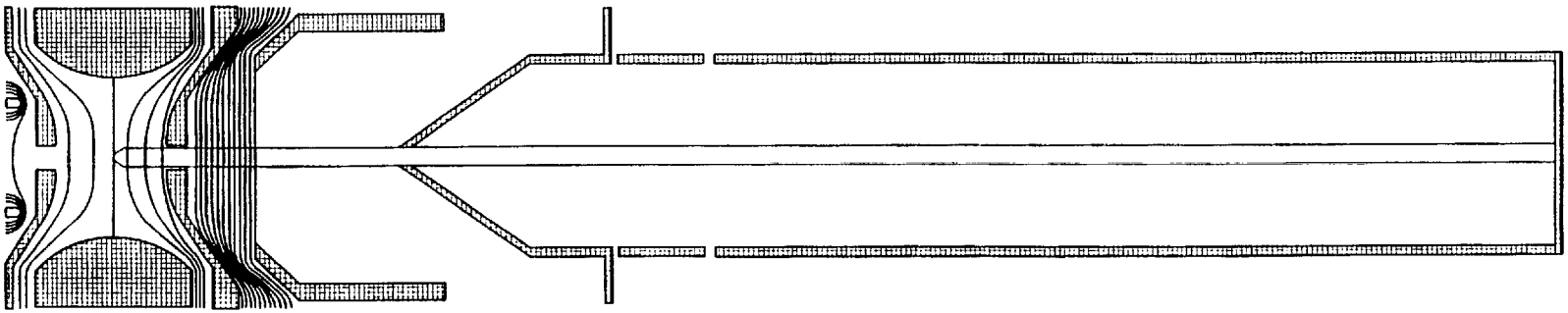
Fig. 1 (PRIOR ART)
FIG. 1 shows a cross-sectional view through a known quadrupole ion trap and associated drift tube.
Figure 2:
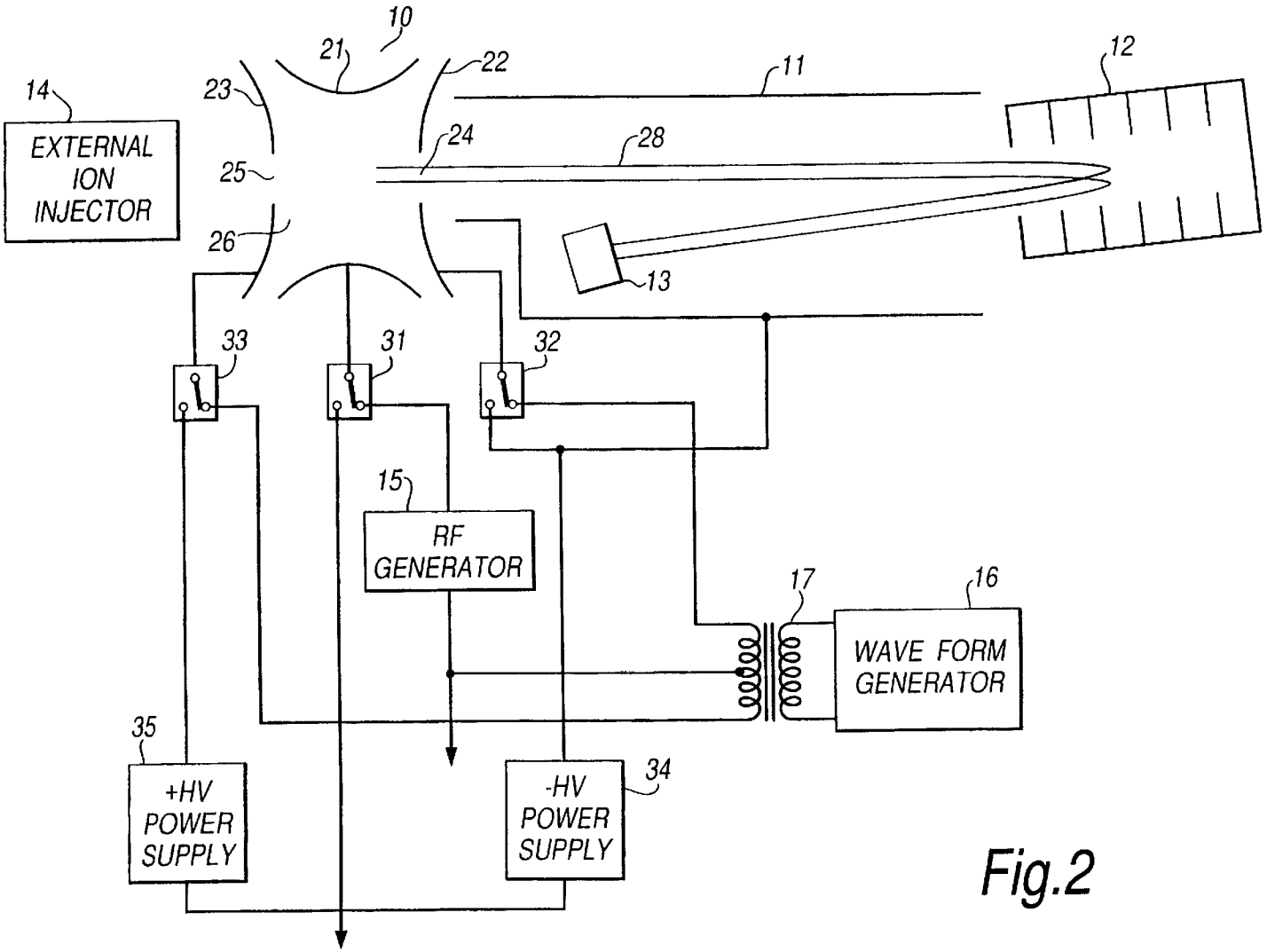
FIG. 2 is a schematic representation of a time-of-flight mass spectrometer according to the invention.

Referring to FIG. 2, the time-of-flight mass spectrometer comprises a quadrupole ion trap 10, a drift tube 11 defining a field-free drift space, an ion ref lector 12 and an ion detector 13. The quadrupole ion trap 10 itself comprises a ring electrode 21 and two end-cap electrodes 22 and 23. End-cap electrode 22 has a hole 24 through which ions are extracted to form an ion beam 28. End-cap electrode 23 also has a hole 25 through which ions produced by an external ion injector 14 can pass for injection into the trap volume 26 of the quadrupole ion trap 10. In an alternative arrangement, the ions to be analysed are formed inside the quadrupole ion trap 10. In this case, the external ion injector 14 is replaced by an electron injector and ions are produced inside the trap volume 26 of the quadrupole ion trap 10 by electron impact ionization of sample atoms and/or molecules.

Three switching devices 31, 32 and 33 normally connect the ring electrode 21 to an RF generator 15 and end-cap electrodes 22 and 23 to ground through a transformer 17 which produces a dipole electric field inside the quadrupole ion trap 10. The form of the dipole electric field is determined by the output of a waveform generator 16 also connected to the transformer 17. This arrangement facilitates a range of different methods for handling ions, such as selecting or eliminating specific ions and/or causing fragmentation to perform MS/MS analysis. The transformer could be replaced by low impedance amplifiers with opposite polarities.

The switches 31, 32 and 33 have another connection which is used in an extraction mode when ions are to be extracted from the trap volume 26 of the quadrupole ion trap 10 and ejected into the field-free drift space. In the extraction mode, switch 31 connects the ring electrode 21 to ground whereby to terminate the RF voltage during the extraction period. Switch 32 connects end-cap electrode 22 to a negative high-voltage power supply 34 and switch 33 connects end-cap electrode 23 to a positive high-voltage power supply 35. The negative high-voltage power supply 34 is also connected to drift tube 11. The described polarities apply when the ions to be analysed are positive. The polarities would be reversed in the case of negative ions.

Figure 3:
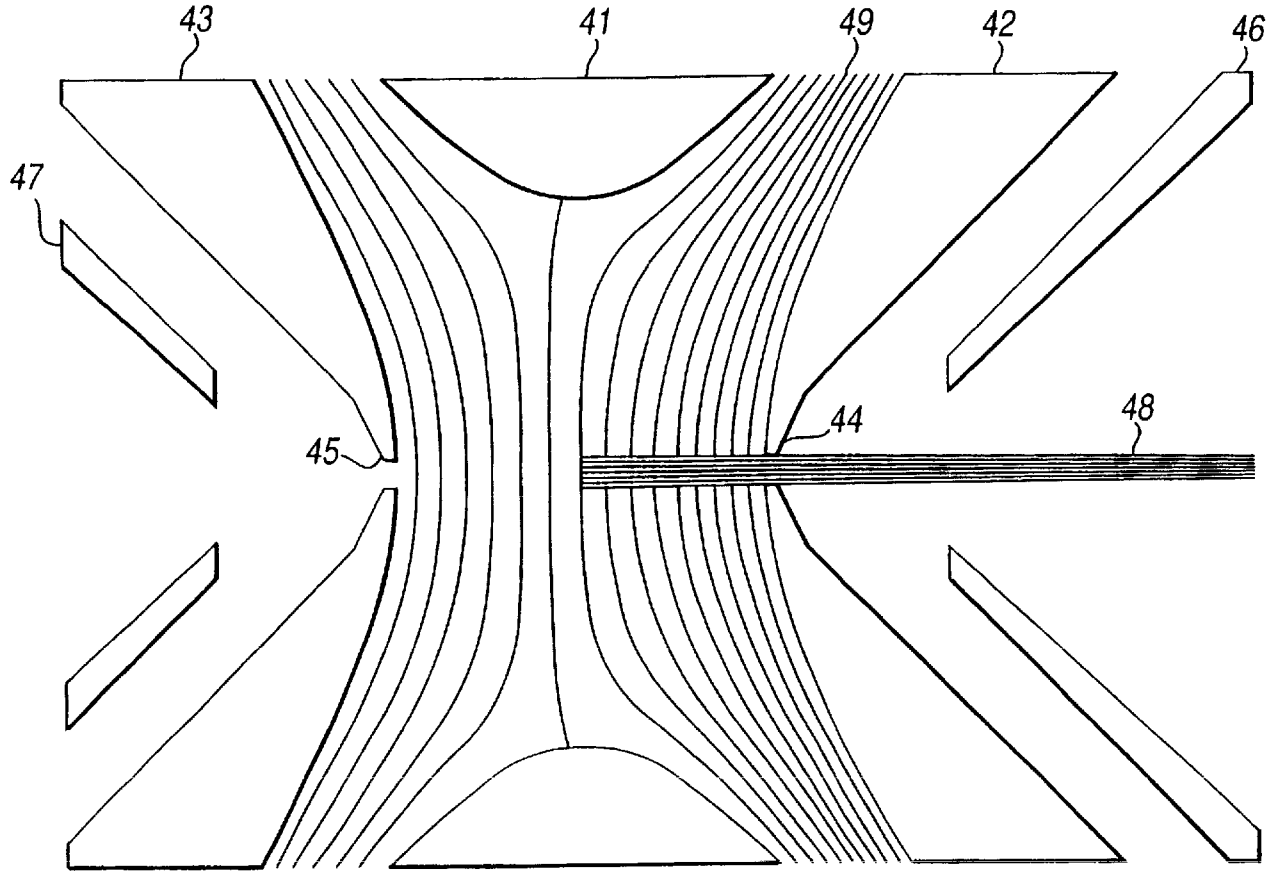
FIG. 3 is an enlarged cross-sectional view through the central parts of a quadrupole ion trap used in the time-of-flight mass spectrometer of FIG. 2.

Referring now to FIG. 3 parts of the ring electrode 41, the end-cap electrodes 42 and 43 having holes 44 and 45, respectively, part of the drift tube 46 and a part of the external ion injector 47 are shown on an enlarged scale. This Figure shows equi-potential lines 49, in steps of 1 kv produced when a voltage of −10 kV is applied to the extraction end-cap electrode 42 and to the drift tube 46 and when a voltage of +6 kV is applied to the other end-cap electrode 43, these voltages being expressed with respect to the grounded ring electrode 41. Accordingly, in this embodiment, the ratio of the applied voltages has the aforementioned optimum value of 0.6. The ions around the centre of the quadrupole ion trap where the electric potential is about −1 kV relative to ground form an ion beam 48 which initially converges in the direction of the end-cap electrode 42 and is subsequently caused to diverge around the hole 44 to form a parallel ion beam in the field-free drift space.

The ions to be mass analysed in time-of-flight mass spectrometer of this embodiment are prepared by an external ion injector such as by matrix-assisted laser desorption/ionization (MALDI) and are selected depending on their mass-to-charge ratio and concentrated into a small region at the centre of the quadrupole ion trap 10 using standard techniques usually adopted in this field. At this moment ions are trapped by RF electric field produced by the RF generator 15. Before ion extraction, the trapping field is switched off by the switching device 31 and the extraction voltages are applied to the end-cap electrodes 22 and 23 using switching devices 32, 33. Provided the switching of the switching device 31 is fast enough the trapping field can be switched off and the extraction voltages applied at exactly the same time. However, because of the high voltages involved, the voltages appearing at the end-cap electrodes may have delays and/or may exhibit a finite rise time to reach the required values. Variations in delay times and rise times of the extraction voltages were investigated and it was found that mass resolution does not show a significant change, whereas the time-of-flight suffers a time shift equal to half of the rise time of the switching devices measured from appearance of the voltages. It will be understood that the positive voltage and the negative voltage need not necessarily be switched at the same time nor do they need to have a linear slope to reach their final voltage values nor need they exhibit the same voltage variation a s they approach those values. There may also be a delay between activation of the two switching devices 32, 33. Ideally, switching of the voltages should have been completed, and the voltages should have settled to their final values, within about 200 nanoseconds, and preferably within about 100 nanoseconds. However, it is necessary that the switching delay and the pulse shape resulting from the variation in voltage as a function of time be highly reproducible so that the same compensating shift in flight time can be applied each time ions are extracted from the ion trap.

What is claimed is:

1. A time-of-flight mass spectrometer comprising a quadrupole ion trap as an ion source, an ion detector and a field-free drift space between the quadrupole ion trap and the ion source, the quadrupole ion trap having a ring electrode and two end-cap electrodes, at least one of the end-cap electrodes having at least one hole at its centre through which ions can be extracted in use, and voltage supply means for supplying to said at least one end-cap electrode a first extraction voltage relative to said ring electrode and for supplying to another said end-cap electrode a second extraction voltage relative to said ring electrode having the opposite polarity to said first extraction voltage, said first and second extraction voltages being respectively negative and positive voltages for positive ion extraction and being respectively positive and negative voltages for negative ion extraction, the second extraction voltage having a magnitude in the range from 0.5 to 0.8 of that of said first extraction voltage.

2. A time-of-flight mass spectrometer as claimed in claim 1, wherein the ions to be extracted are positive ions, said first extraction voltage is a negative voltage and said second extraction voltage is a positive voltage.

3. A time-of-flight mass spectrometer as claimed in claim 1, wherein the ions to be extracted are negative ions, said first extraction voltage is a positive voltage and said second extraction voltage is a negative voltage.

4. A time-of-flight mass spectrometer as claimed in claim 1, wherein said second extraction voltage has a magnitude which is 0.6 that of said first extraction voltage.

5. A time-of-flight mass spectrometer as claimed in claim 1, wherein said first extraction voltage is also applied to the field-free drift space.

6. A time-of-flight mass spectrometer as claimed in claim 1, wherein said end-cap electrodes and said ring electrode enclose a trap volume, the voltage supply means is arranged to supply to the end cap electrodes further voltages to confine and/or control ions within said trap volume, and includes switching means for switching between said further voltages and said first and second extraction voltages.

7. A time-of-flight mass spectrometer as claimed in claim 6 wherein said switching means effects switching from said further voltages to said first and second extraction voltages within a time interval of less than 200 nanoseconds.

8. A time-of-flight mass spectrometer as claimed in claim 1, wherein the field-free drift space includes an ion reflector.

9. A method for forming an ion beam using a quadrupole ion trap having a ring electrode and two end-cap electrodes, at least one of the end-cap electrodes having at least one hole at its centre through which ions can be extracted in use, the method comprising supplying to said at least one end-cap electrode a first extraction voltage relative to said ring electrode and supplying to another said end-cap electrode a second extraction voltage relative to said ring electrode, having the opposite polarity to said first extraction voltage, said first and second extraction voltages being respectively negative and positive voltages for positive ion extraction and being respectively positive and negative voltages for negative ion extract ion; the second extraction voltage having a magnitude in the range from 0.5 to 0.8 of that of said first extraction voltage.

10. A method as claimed in claim 9, wherein the ions to be extracted are positive ions, said first extraction voltage is a negative voltage and said second extraction voltage is a positive voltage.

11. A method as claimed in claim 9, wherein the ions to be extracted are negative ions, said first extraction voltage is a positive voltage and said second extraction voltage is a negative voltage.

12. A method as claimed in claim 9, wherein said second extraction voltage has a magnitude which is 0.6 that of said first extraction voltage.

13. A method as claimed in claim 9 including applying said first extraction voltage to a field-free drift region of a time-of-flight mass spectrometer incorporating the quadrupole ion trap.

14. A method as claimed in claim 9 including applying to the end cap electrodes further voltages suitable for confining and/or controlling ions within a trap volume enclosed by the end-cap electrodes and said ring electrode and including switching between said further voltages and said first and second extraction voltages.

15. A method as claimed in claim 14 including switching from said further voltages to said first and second extraction voltages within a time interval of less than 200 nanoseconds.

16. A quadrupole ion trap having a ring electrode and two end-cap electrodes, at least one of said end cap electrodes having at least one hole at its centre through which ions can be extracted in use, and voltage supply means for supplying to said at least one end-cap electrode a first extraction voltage relative to said ring electrode and for supplying to another said end-cap electrode a second extraction voltage relative to said ring electrode having the opposite polarity to said first extraction voltage, said first and second extraction voltages being respectively negative and positive voltages for positive ion extraction and being respectively positive and negative voltages for negative ion extraction, the second extraction voltage having a magnitude in the range from 0.5 to 0.8 of that of said first extraction voltage.

17. A quadrupole ion trap as claimed in claim 16, wherein said second extraction voltage is 0.6 that of said first extraction voltage.

* * * * *